US005913597A

United States Patent [19]

Lin

[11] Patent Number: 5,913,597

[45] Date of Patent: Jun. 22, 1999

[54] PARALLEL LAMP ASSEMBLY

[76] Inventor: Mei-Lu Lin, 56, Min Sheng Street, Fengyuan, Taichung Shien, Taiwan, 420

[21] Appl. No.: 08/921,223

[22] Filed: Aug. 27, 1997

[51] Int. Cl.[6] ..... H01R 33/00

[52] U.S. Cl. ..... 362/226; 362/227; 362/249; 362/252; 362/806

[58] Field of Search ..... 362/252, 249, 362/122, 123, 806, 808, 227, 226, 396; 248/314

[56] References Cited

U.S. PATENT DOCUMENTS

| | | | |
|---|---|---|---|
| 2,047,045 | 7/1936 | Veenboer | 362/122 |
| 4,890,206 | 12/1989 | Lee | 362/227 |
| 5,367,443 | 11/1994 | Hara | 362/227 |
| 5,510,996 | 4/1996 | Konecny | 362/249 |
| 5,664,877 | 9/1997 | Wu | 362/252 |

*Primary Examiner*—Sandra O'Shea
*Assistant Examiner*—Marshall Honeyman

[57] ABSTRACT

A parallel lamp assembly has a first decoration lamp and a second decoration lamp. Each decoration lamp has a socket, an insertion recess formed in the socket, an insertion groove formed in the socket, a flat plate disposed on the socket, a recessed plate disposed on the socket, a lamp holder inserted in the socket, a bulb disposed on the lamp holder, a first conductive plate connected to a first wire, a second conductive plate connected to a second wire, the first conductive plate inserted in the insertion groove, the second conductive plate inserted in the insertion recess, the first wire extended outward from the socket, and the second wire extended outward from the socket. A bar is connected to the flat plate and the socket. A positioning slot and a slide channel are formed on the recessed plate.

3 Claims, 7 Drawing Sheets

PARALLEL LAMP ASSEMBLY

BACKGROUND OF THE INVENTION

This invention relates to a parallel lamp assembly, and more particularly to a parallel lamp assembly which contains a plurality of decoration lamps side by side.

A conventional lamp assembly has a large number of decoration lamps in series. However, it is difficult to hang a large number of decoration lamps in series on a Christmas tree.

SUMMARY OF THE INVENTION

An object of this invention is to provide a parallel lamp assembly which a plurality of decoration lamps to be arranged side by side in order to form various patterns.

DETAILED DESCRIPTION OF THE INVENTION

Figure 1:
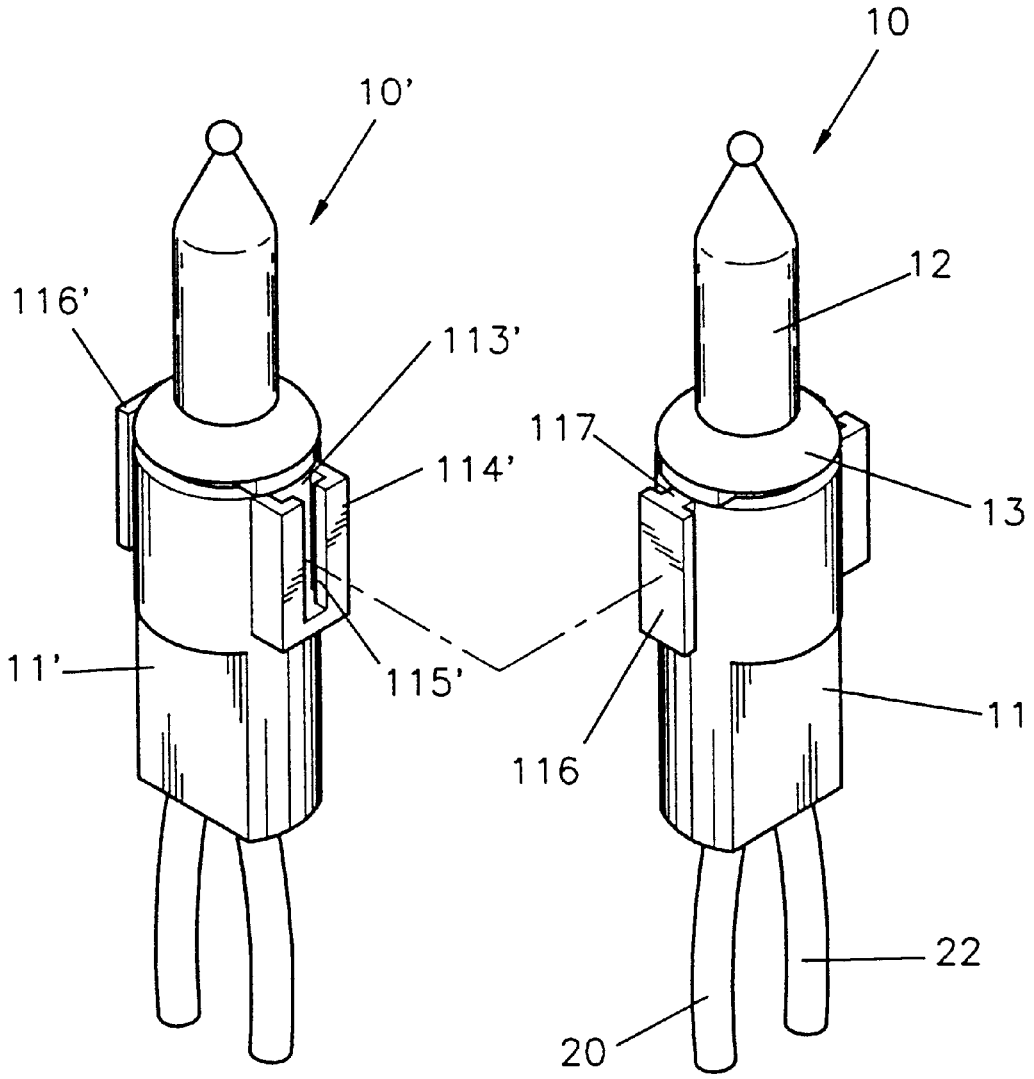
FIG. 1 is a perspective exploded view of a parallel lamp assembly of a first embodiment.
Figure 2:
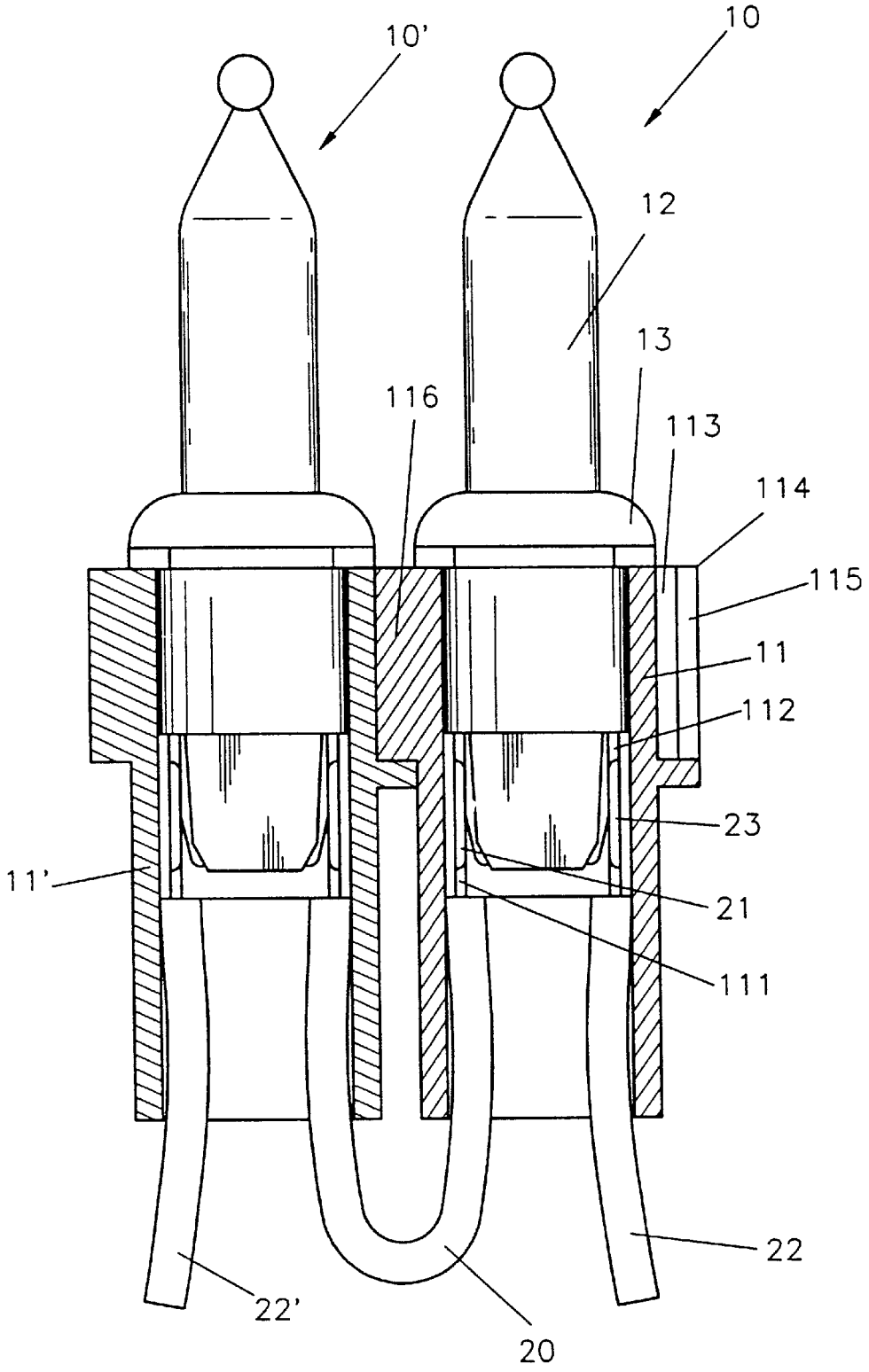
FIG. 2 is a sectional assembly view of a parallel lamp assembly of a first embodiment.

Referring to FIGS. 1 and 2, a first parallel lamp assembly comprises at least a first decoration lamp 10 and a second decoration lamp 10' coupled with the first decoration lamp 10 side by side. The first decoration lamp 10 has a first socket 11, a first insertion recess 111 formed in the first socket 11, a first insertion groove 112 formed in the first socket 11, a first flat plate 116 disposed on the first socket 11, a first recessed plate 114 disposed on the first socket 11, a first lamp holder 13 inserted in the first socket 11, a first bulb 12 disposed on the first lamp holder 13, a first conductive plate 23 connected to a first wire 22, a second conductive plate 21 connected to a second wire 20, the first conductive plate 23 inserted in the first insertion groove 112, the second conductive plate 21 inserted in the first insertion recess 111, the first wire 22 extended outward from the first socket 11, and the second wire 20 extended outward from the first socket 11. A first bar 117 is connected to the first flat plate 116 and the first socket 11. A first positioning slot 113 and a first slide channel 115 are formed on the first recessed plate 114.

The second decoration lamp 10' comprises a second socket 11', a second flat plate 116 disposed on the second socket 11', a second recessed plate 114' disposed on the second socket 11', a first wire 22' extended outward from the second socket. 11', and the second wire 20 extended outward from the second socket 11'. A second positioning slot 113' and a second slide channel 115' are formed on the second recessed plate 114'.

The first flat plate 116 engages with the second recessed plate 114'.

Figure 3:
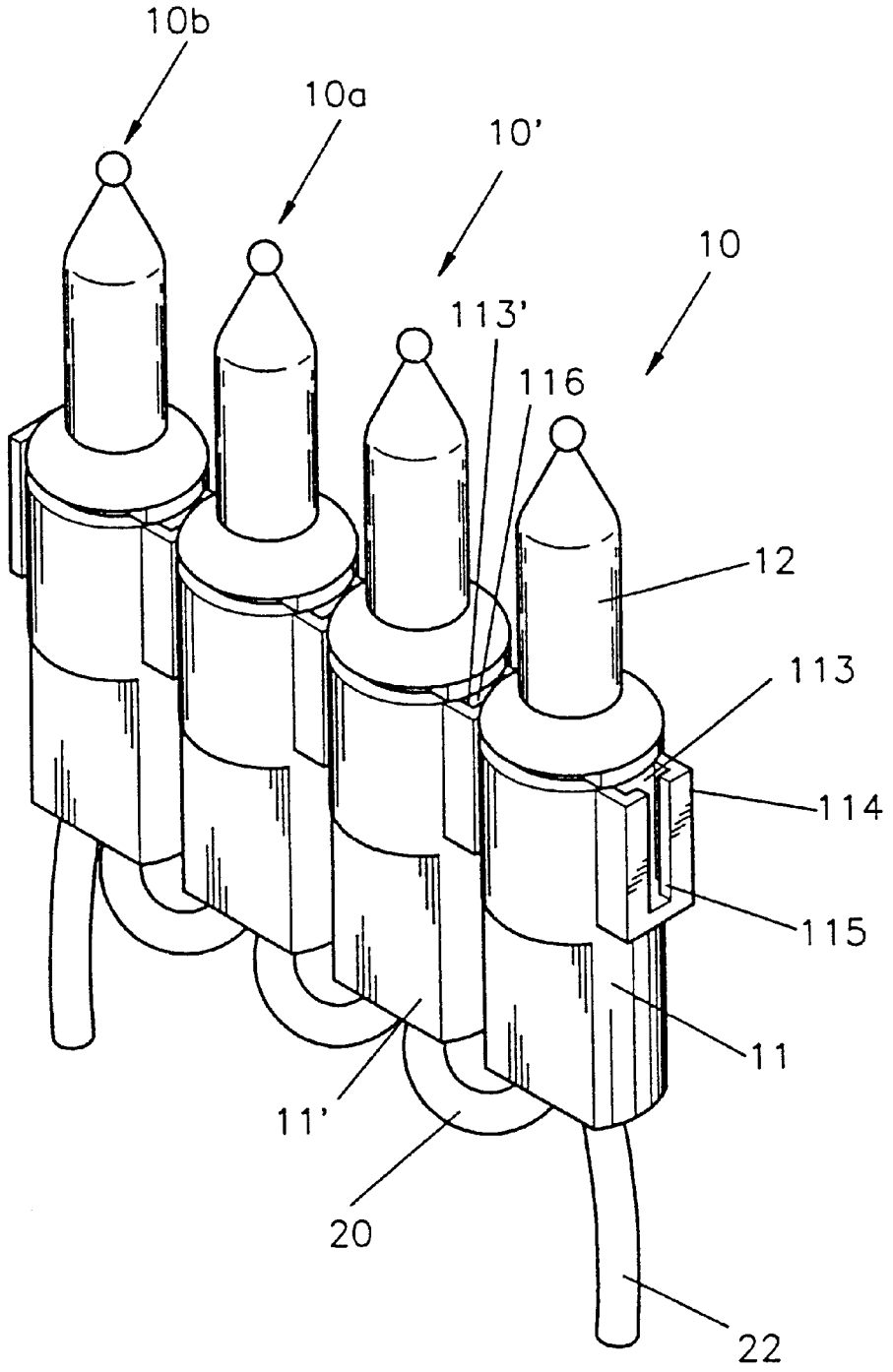
FIG. 3 is a perspective assembly view of a parallel lamp assembly of a first embodiment.

Referring to FIG. 3, the first parallel lamp assembly comprises a first decoration lamp 10, a second decoration lamp 10' coupled with the first decoration lamp 10, a third decoration lamp 10*a* coupled with the second decoration lamp 10', and a fourth decoration lamp 10*b* coupled with the third decoration lamp 10*a*.

Figure 4:
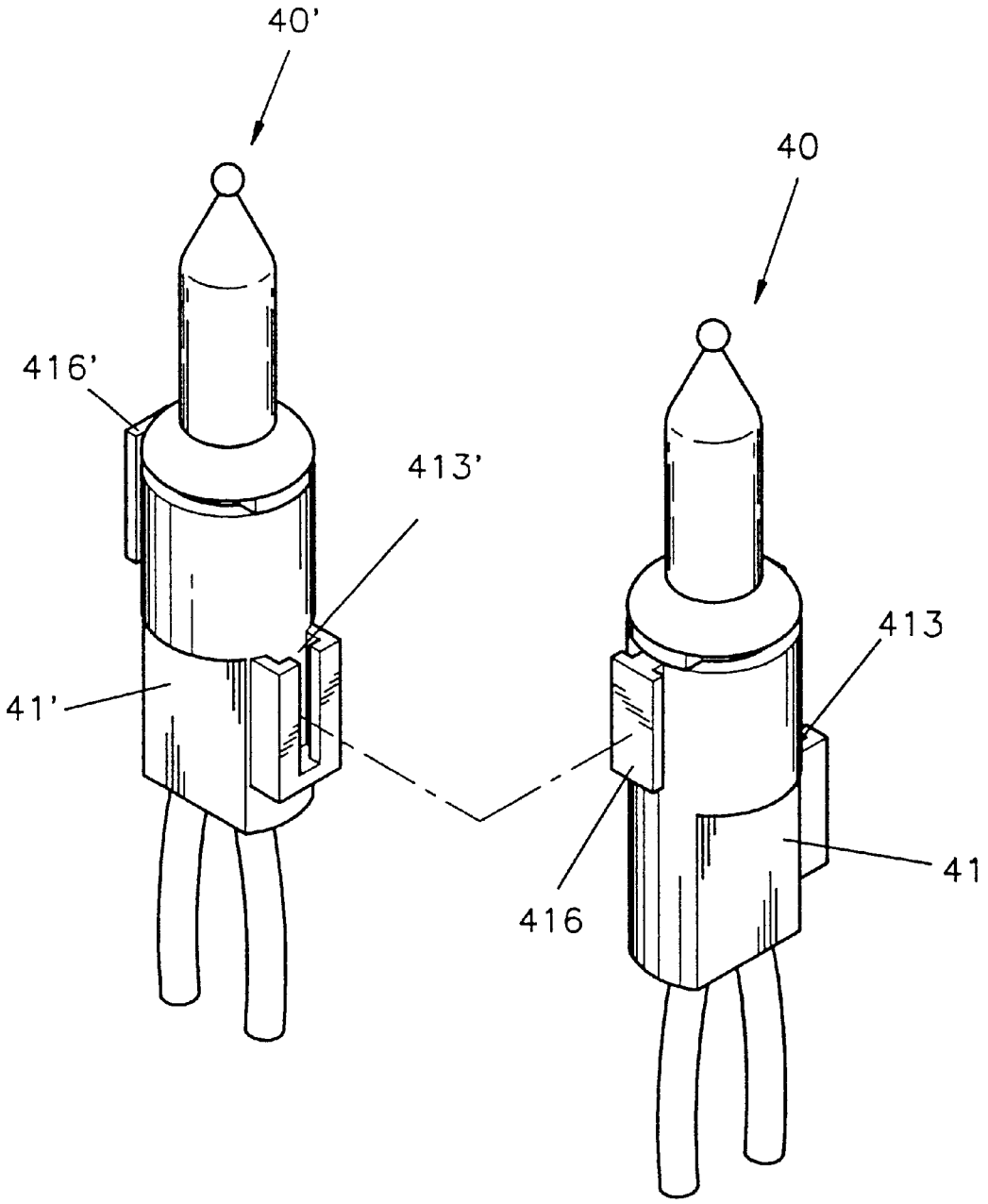
FIG. 4 is a perspective exploded view of a parallel lamp assembly of a second embodiment.

Referring to FIG. 4, a second parallel lamp assembly comprises at least a first decoration lamp 40 and a second decoration lamp 40' coupled with the first decoration lamp 40 side by side. Each decoration lamp 40 or 40' has a socket 41 or 41', a flat plate 416 or 416' disposed on an upper periphery of the socket 41 or 41', and a recessed plate 413 or 413' disposed on a lower periphery of the socket 41 or 41'.

Figure 5:
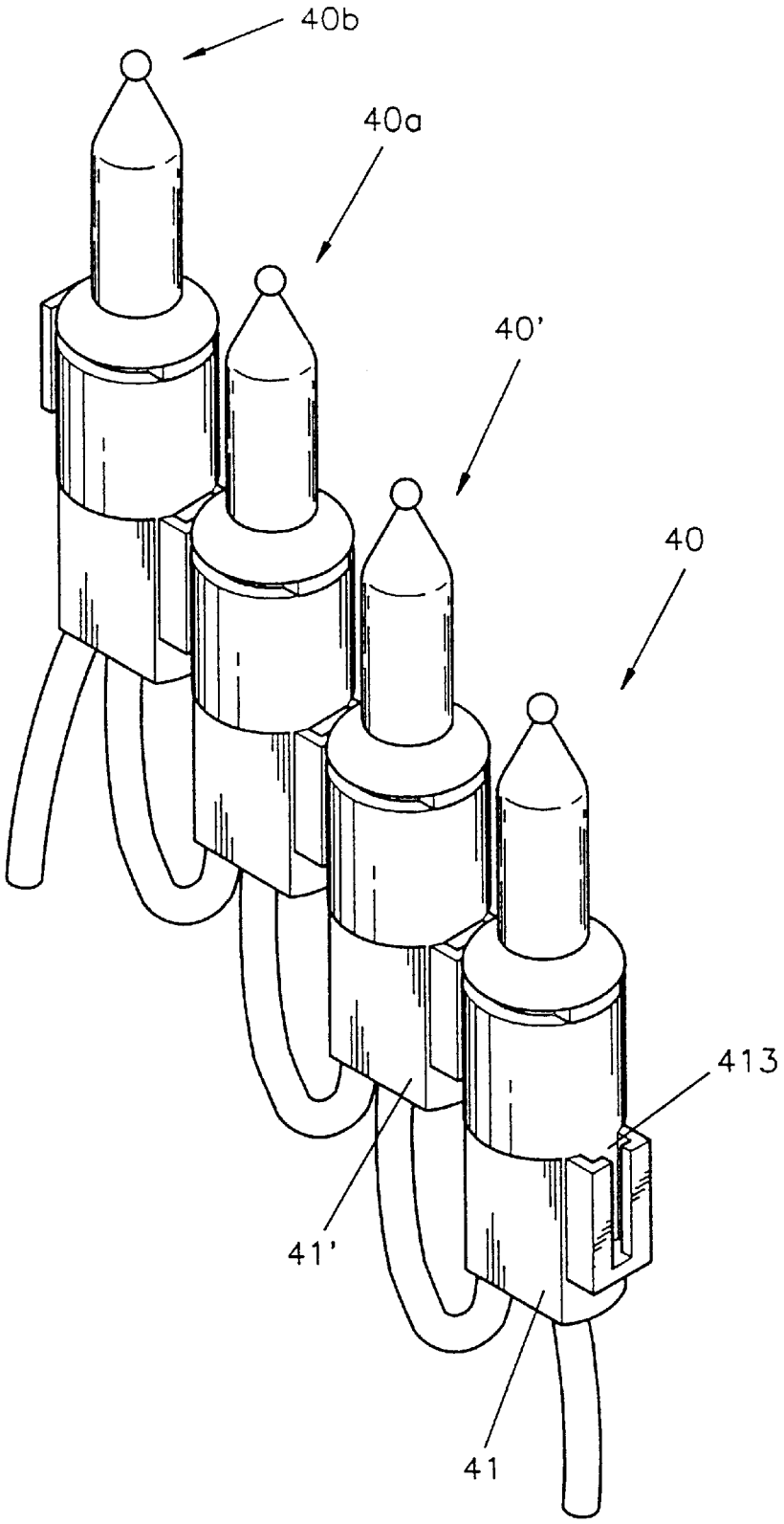
FIG. 5 is a perspective assembly view of a parallel lamp assembly of a second embodiment.

Referring to FIG. 5, the second parallel lamp assembly comprises a first decoration lamp 40, a second decoration lamp 40' coupled with the first decoration lamp 40, a third decoration lamp 40*a* coupled with the second decoration lamp 40', and a fourth decoration lamp 40*b* coupled with the third decoration lamp 40*a*.

Figure 6:
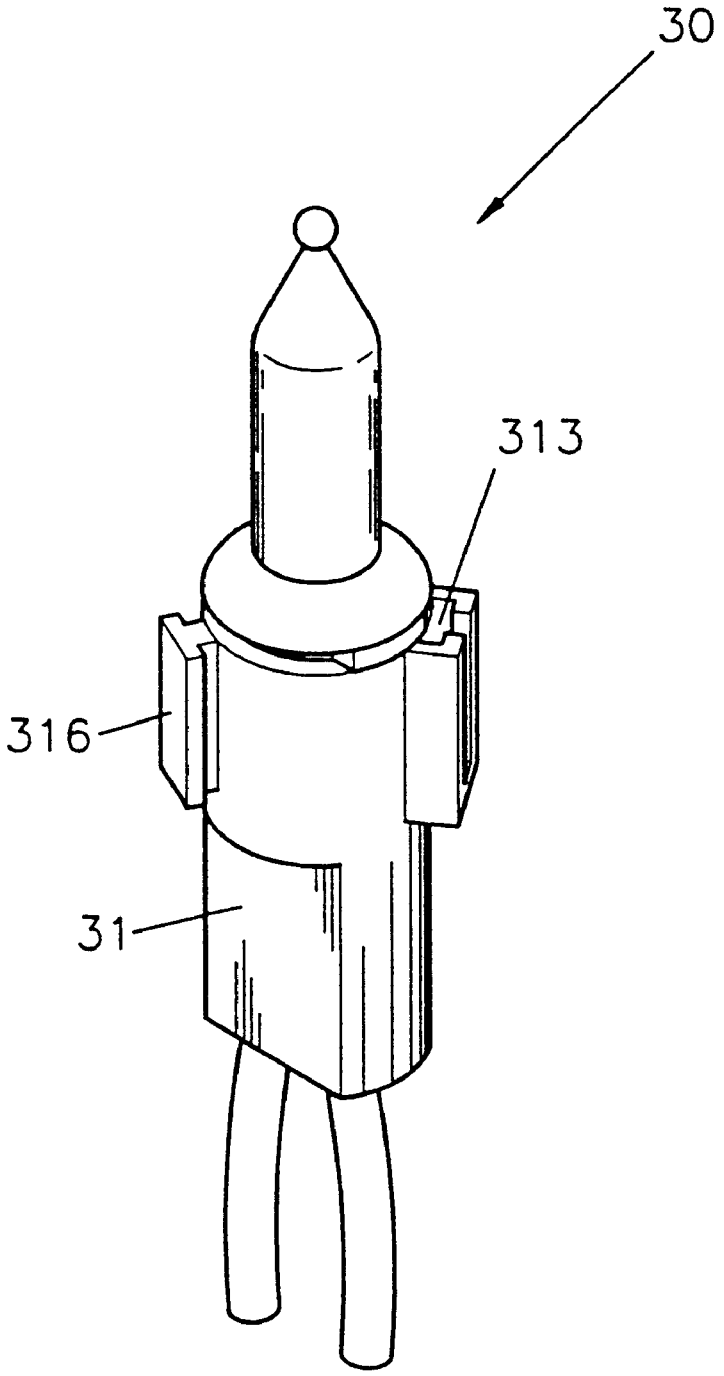
FIG. 6 is a perspective view of a decoration lamp of a third embodiment.

Referring to FIG. 6, a third parallel lamp assembly comprises at least a decoration lamp 30. The decoration lamp 30 has a socket 31, a flat plate 316 disposed on an upper periphery of the socket 31, and a recessed plate 313 disposed on the upper periphery of the socket 31. The flat plate 316 and the recessed plate 313 are arranged in a predetermined angle.

Figure 7:
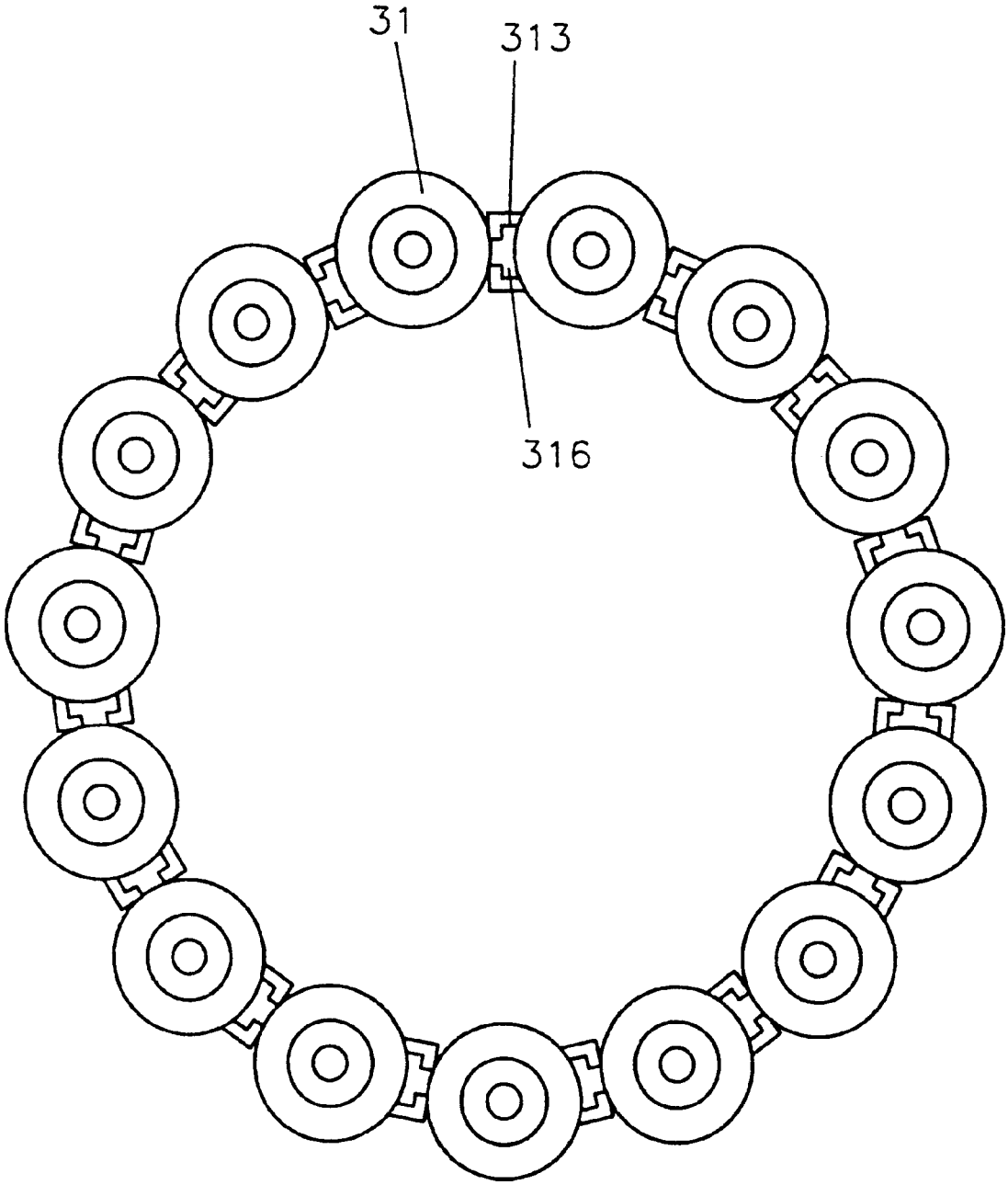
FIG. 7 is a perspective assembly view of a parallel lamp assembly of a third embodiment.

Referring to FIG. 7, the third parallel lamp assembly comprises a large number of decoration lamps 30 arranged in a circle.

I claim:

1. A parallel lamp assembly comprises:

at least a first decoration lamp and a second decoration lamp coupled with the first decoration lamp side by side, each said decoration lamp having a socket, an insertion recess formed in the socket, an insertion groove formed in the socket, a flat plate disposed on the socket, a recessed plate disposed on the socket, a lamp holder inserted in the socket, a bulb disposed on the lamp holder, a first conductive plate connected to a first wire, a second conductive plate connected to a second wire, the first conductive plate inserted in the insertion groove, the second conductive plate inserted in the insertion recess, the first wire extended outward from the socket, the second wire extended outward from the socket, a bar connected to the flat plate and the socket, and a positioning slot and a slide channel formed on the recessed plate.

2. A parallel lamp assembly as claimed in claim 1, wherein the flat plate is disposed on an upper periphery of the socket.

3. A parallel lamp assembly as claimed in claim 1, wherein the recessed plate is disposed on a lower periphery of the socket.

* * * * *